US008147217B2

(12) United States Patent
Lengert et al.

(10) Patent No.: US 8,147,217 B2
(45) Date of Patent: Apr. 3, 2012

(54) PUMP DEVICE

(75) Inventors: Jörg Lengert, Lonnerstadt-Ailsbach (DE); Roland Lutz, Erlangen (DE); Norbert Weinberg, Baiersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 724 days.

(21) Appl. No.: 12/227,566

(22) PCT Filed: May 4, 2007

(86) PCT No.: PCT/EP2007/054349

§ 371 (c)(1),
(2), (4) Date: Nov. 21, 2008

(87) PCT Pub. No.: WO2007/137927

PCT Pub. Date: Dec. 6, 2007

(65) Prior Publication Data

US 2009/0148316 A1 Jun. 11, 2009

(30) Foreign Application Priority Data

May 31, 2006 (DE) ..... 10 2006 025 762

(51) Int. Cl.
*F04B 39/06* (2006.01)
*F04B 39/02* (2006.01)

(52) U.S. Cl. ..... 417/373; 417/321; 417/338; 417/390; 417/423.8; 417/372; 417/44.1; 417/44.11

(58) Field of Classification Search ..... 417/372, 417/373, 321, 338, 390, 423.8, 44.1, 44.11
See application file for complete search history.

(56) References Cited

U.S. PATENT DOCUMENTS

| | | | | |
|---|---|---|---|---|
| 1,291,407 | A | 1/1919 | Chapman | |
| 3,550,727 | A * | 12/1970 | McCain | 188/82.9 |
| 3,928,841 | A * | 12/1975 | Vogel | 340/854.5 |
| 4,778,355 | A * | 10/1988 | Holland | 417/378 |
| 5,143,153 | A * | 9/1992 | Bach et al. | 166/68.5 |
| 5,145,322 | A * | 9/1992 | Senior et al. | 417/32 |
| 5,147,530 | A | 9/1992 | Chandler et al. | |
| 5,996,691 | A * | 12/1999 | Norris et al. | 166/250.03 |
| 6,079,491 | A * | 6/2000 | Stuebinger et al. | 166/266 |
| 6,092,600 | A * | 7/2000 | McKinzie et al. | 166/266 |
| 6,113,355 | A * | 9/2000 | Hult et al. | 417/214 |
| 6,125,931 | A * | 10/2000 | Hult et al. | 166/68.5 |
| 6,454,010 | B1 * | 9/2002 | Thomas et al. | 166/369 |
| 6,585,041 | B2 * | 7/2003 | Crossley | 166/53 |
| 6,843,313 | B2 * | 1/2005 | Hult | 166/78.1 |
| 7,074,017 | B2 * | 7/2006 | Coray et al. | 417/360 |

(Continued)

FOREIGN PATENT DOCUMENTS

DE 19616578 C1 7/1997

(Continued)

*Primary Examiner* — Nimeshkumar Patel
*Assistant Examiner* — Thomas A Hollweg

(57) ABSTRACT

The invention relates to a pump device for feeding a delivery medium out of a deep borehole which leads from a floor level into the interior of the earth, which deep borehole is provided at least in sections with borehole piping, having a pump and having a motor which drives the pump. As a result of the motor being arranged outside the borehole piping and as a result of it being possible for the motor to be connected to the pump by means of torque transmitting means which extend laterally through the borehole piping, the motor can be protected from overheating, and in the event of a fault, can be pulled out of the deep borehole independently of the pump.

12 Claims, 2 Drawing Sheets

U.S. PATENT DOCUMENTS

| | | | | |
|---|---|---|---|---|
| 7,437,215 | B2 * | 10/2008 | Anderson et al. | 700/282 |
| 7,534,096 | B2 * | 5/2009 | Schulz | 417/45 |
| 7,645,124 | B2 * | 1/2010 | Garlow | 417/44.2 |
| 2004/0062658 | A1 | 4/2004 | Beck et al. | |
| 2005/0045323 | A1 * | 3/2005 | Hult | 166/68.5 |
| 2005/0084401 | A1 * | 4/2005 | Coray et al. | 417/423.14 |
| 2005/0281680 | A1 * | 12/2005 | Schulz | 417/44.11 |
| 2005/0281681 | A1 * | 12/2005 | Anderson et al. | 417/44.11 |
| 2006/0011152 | A1 * | 1/2006 | Hayes | 123/41.49 |
| 2008/0142209 | A1 * | 6/2008 | Mello et al. | 166/53 |
| 2008/0257555 | A1 * | 10/2008 | Waldenstrom et al. | 166/369 |

FOREIGN PATENT DOCUMENTS

| | | | |
|---|---|---|---|
| EP | 1132620 | A2 | 9/2001 |

* cited by examiner

PUMP DEVICE

CROSS REFERENCE TO RELATED APPLICATIONS

This application is the US National Stage of International Application No. PCT/EP2007/054349, filed May 4, 2007 and claims the benefit thereof. The International Application claims the benefits of German application No. 10 2006 025 762.6, filed May 31, 2006, both of the applications are incorporated by reference herein in their entirety.

FIELD OF THE INVENTION

The invention relates to a pump device for delivering a delivery medium out of a deep borehole, which leads from ground level into the interior of the earth and is lined at least in sections with borehole piping, having a pump and a motor, which drives the pump and is arranged outside the borehole piping.

BACKGROUND OF THE INVENTION

In the field of drilling, in particular deep borehole engineering, pump devices, in particular immersion pumps, are used to deliver for example hydrocarbons in liquid form and/or thermal water. According to the prior art these pumps are configured as a unit comprising a pump and a motor. This unit operates hundreds of meters down in borehole piping and is thereby in direct contact with the delivery medium, which being a thermal water containing hydrocarbons for example has a high temperature. Because of the hot delivery medium, in particular in the case of thermal water delivery, and due to the waste heat generated during operation of the motor, the pump operating temperature and/or motor operating temperature is/are very high. This has a negative influence on the useful life of the pump and/or motor. In particular the motor, which drives the pump, and generates waste heat due to friction and field losses, is at particular risk when the delivery medium has a high temperature. Also a power supply for the motor has to be conducted downward through the borehole piping by means of a cable that is protected against mechanical damage and water to the actual pump site.

According to the prior art such pump devices are designed so that the pump motor temperature cannot exceed a critical temperature value. The difference between nominal operating temperature and actual operating temperature is a measure of the useful life of pump devices, in particular for the pump motor. If for example the actual operating temperature or even the ambient temperature is already above the nominal operating temperature and also close to the critical temperature value, the useful life of the pump device will be considerably shorter than with operation at nominal operating temperature. Designing for long-term operation at nominal operating temperature can be made difficult or even totally impossible for example due to the following constraints:

The delivery medium, in particular hydrocarbons and/or thermal water, already has such a high temperature itself that operation at nominal operating temperature and the required difference in relation to the critical operating temperature are not ensured.

The required delivery output of the pump is so high that the resulting heat wasted by the motor comes into the region of the critical temperature.

So-called rod pumps are also used in addition to the pump device described above. Such rod pumps have the advantage that the pump can work deep down in the bore piping, while the associated motor is installed above ground. The motor can thus be operated above ground in a relatively non-critical manner in respect of excessive operating temperatures. As the motor and pump are connected mechanically to one another by means of a rod, this solution reaches its delivery limit and/or its mechanical loading capacity at a depth of around 300 m. Such a pump device is already known from U.S. Pat. No. 1,291,407.

It is a particular disadvantage of the prior art that if the motor fails, the complete immersion pump has to be withdrawn from the deep borehole to replace the motor. Such an instance of damage to the immersion pump can result in downtimes of 3 to 4 days.

SUMMARY OF THE INVENTION

The object of the invention is to provide a pump device which avoids the disadvantages of the prior art and in particular permits the delivery of a delivery medium at a deep level with high ambient temperatures.

According to the invention the object is achieved for the pump device mentioned in the introduction in that the motor can be connected to the pump by way of torque transmitting means penetrating the borehole piping laterally. As the motor is now no longer arranged within the borehole piping and as a result no longer comes into contact with the hot delivery medium, the operating temperature of the motor can be kept in a non-critical range. The motor is therefore protected against overheating and can be withdrawn from the deep borehole independently of the pump in the event of a fault or for maintenance purposes.

Connecting the motor to the pump by way of a transmission system makes it possible to set the desired pump speed by way of different motor speeds, it being possible to optimize the speed transmission in respect of a torque to be transmitted.

In a further embodiment of the invention the transmission system and the pump form a structural unit. Such a compact structure, for example with a shared housing, allows smaller mechanical loads to be achieved for a drive train for example between the pump and the transmission system. This in turn permits a higher output for such an embodiment, thereby achieving high delivery quantities.

In an alternative embodiment of the pump device the transmission system and pump are connected by way of a drive shaft that can be displaced along the deep borehole for torque transmission to the pump at different bore depths. This is advantageous for example if certain critical temperature limits also have to be complied with for the transmission system and the pump delivers the delivery medium to the surface in a much deeper and therefore hotter environment. The pump can also monitor a diminishing level of delivery medium.

For both alternatives for the pump device it is advantageous that the deep borehole is extended by a shaft in such a manner that an upper section of the borehole piping is exposed by it, the motor being arranged in said shaft. The motor is accessible from above by way of the shaft realized for example by of an outer borehole. The outer borehole, which has a larger diameter than the borehole piping or the inner borehole, allows the motor to be easily accommodated with the shaft thus provided. The motor is accessible by way of this shaft, for maintenance purposes for example, without the pump, together with the motor and borehole piping, having to be dismantled using a heavy-duty crane. The shaft thus formed also allows a power supply line for the motor to be provided with considerably less mechanical protection than is the case with the prior art.

The motor is expediently connected to a cooling system by way of a cooling line. Because the motor is supplied with a separate cooling medium by way of the motor cooling line, the cooling power of the motor is improved, advantageously allowing operation at high ambient temperatures.

It is also advantageous that the cooling system is arranged at ground level or above. Since generally much lower temperatures prevail at ground level and above than below ground, the cooling system thus arranged can play an effective part in a heat-exchange process and can supply the motor arranged below ground with the required cooling power.

Greater user-friendliness is also achieved in that the motor can be connected to the transmission system by way of a quick-release plug-in connector for repair or maintenance purposes. If the motor fails for example, it can be disconnected particularly easily and quickly from the transmission system and withdrawn from the shaft separately from the transmission system and pump to be repaired or replaced. This significantly reduces the outlay for motor maintenance and/or repair.

BRIEF DESCRIPTION OF THE DRAWINGS

The drawing shows two exemplary embodiments of an inventive pump device, in which.

DETAILED DESCRIPTION OF THE INVENTION

Figure 1:
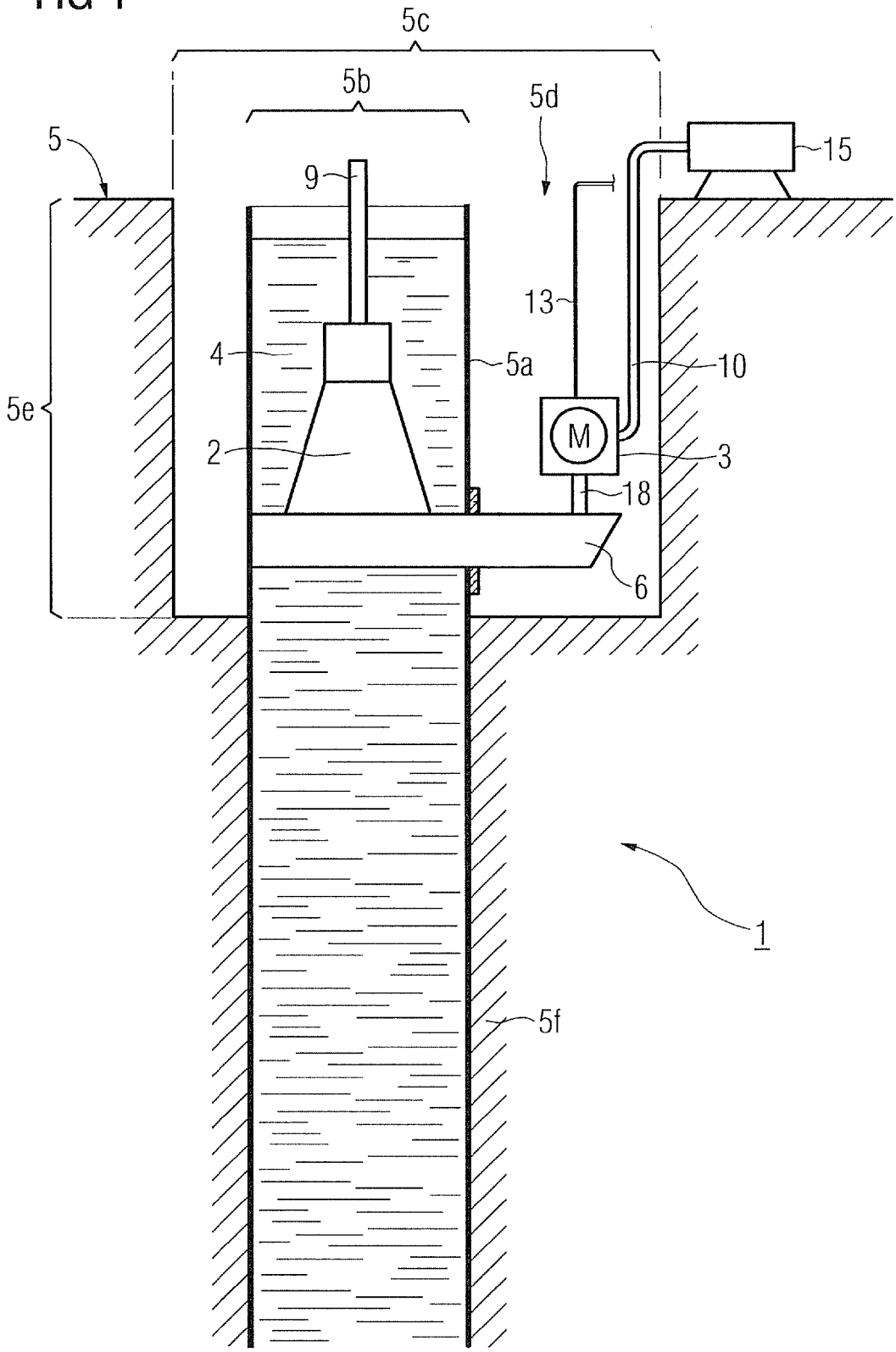
FIG. 1 shows a pump device with a pump and a transmission system as a structural unit and FIG. 2 shows the inventive pump device with a pump and a transmission system at a spatial distance.

FIG. 1 shows a schematic diagram of a pump device 1 for delivering a delivery medium 4—in this instance thermal water—for subsequent geothermal heat and power provision. The properties of the thermal water are determined by below-ground characteristics. The quality of the thermal water can range from drinking water quality to highly mineralized formation waters with for example saturated brines. The requirements for the pump device 1 therefore vary according to application and geological situation, as chemical composition, pressure and temperature, as well as gas content, can differ significantly at different depths and in different geological regions.

In order to extend the useful life of such a pump device 1 and at the same time to keep investment costs incurred for different geological conditions low, in the inventive pump device 1*a* motor 3 is arranged outside borehole piping 5*a* and connected to a pump 2 by means of a transmission system 6. The pump 2 transports the delivery medium 4 out of the borehole piping 5*a* or out of the inner borehole 5*b* or the interior of the earth 5*f* by way of a delivery line 9 to a repository (not shown here) above ground.

In order to provide sufficient space for the motor 3 outside the borehole piping 5*a* at a predefined delivery depth, the inner borehole 5*b* is extended from ground level 5 in such a manner that a shaft 5*d* leads down to the required delivery depth. This shaft 5*d* can be formed for example by an outer borehole 5*c* of larger diameter that extends the inner borehole 5*b* and exposes the borehole piping at least partially over its depth. The shaft 5*d* therefore provides sufficient space for the motor 3 and for a cooling line 10 leading to the surface and for a power supply line 13.

The cooling line 10 connects the motor 3 to a cooling system 15 installed at ground level 5. The motor 3 is accessible from above by way of the shaft 5*d*. The motor 3 is also supplied with power by means of a power supply line 13 by way of the intermediate space 5*d*. No particular requirements are specified for the mechanical protection of the power supply line 13 in contrast to the prior art. Insulation from moisture for the power supply line 13 can also be designed less stringently than is the case for pump devices with a motor within the borehole piping.

As the motor 3 is connected mechanically to the transmission system 6 by way of a quick-release plug-in connector 18, the motor 3 can be disconnected simply from the transmission system 6 in the event of a fault. The disconnected motor 3 can then be transported to ground level 5 for maintenance or a complete replacement. Once the motor 3 has been successfully repaired or the motor 3 has been completely replaced, the motor can be conveyed back underground through the shaft 5*d*. When the motor 3 reaches its working depth, it is reconnected to the transmission system 6 by plugging the plug-in connector 18 into a transmission flange provided for the purpose and is then ready for use.

Figure 2:
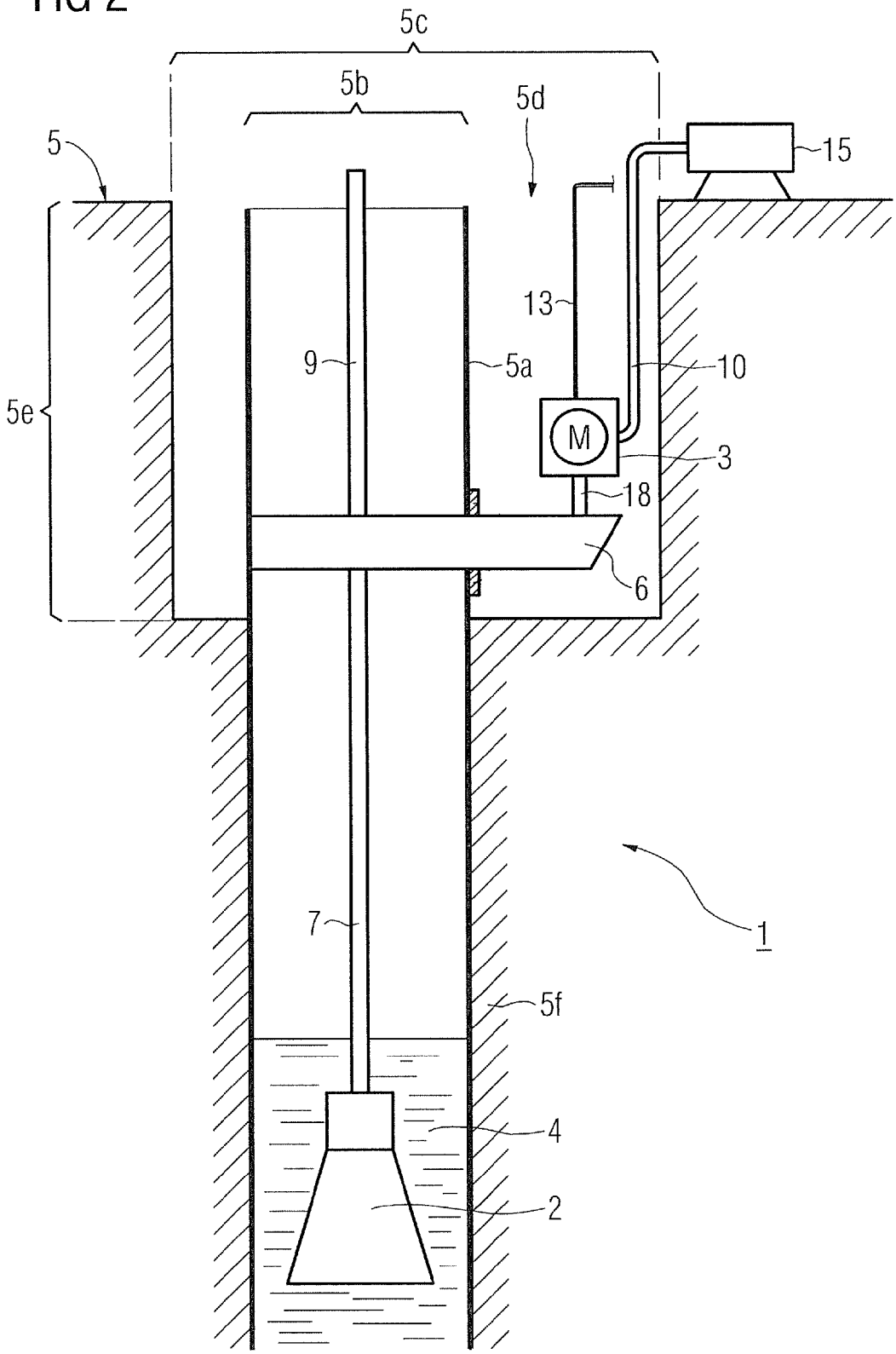

FIG. 2 shows a schematic diagram of a further exemplary embodiment of a pump device 1 for delivering the delivery medium 4. The pump device 1 has the particular feature that the pump 2 and transmission system 6 are connected by way of a drive shaft 7, which is configured as a pump rod.

The pump device is therefore realized by means of a so-called rod pump 2, 7. These rod pumps 2, 7 are also referred to as line shaft pumps in specialist circles. This alternative embodiment of a pump device 1 with a rod pump 2, 7 is used to great advantage whenever the drilling device used is unable to drill or sink an upper section 5*e* of the borehole piping 5*a* to the required depth. The motor 3 with its transmission system 6 is positioned at the maximum depth that an outer borehole 5*c* can reach. Since, as mentioned above, the maximum depth of the outer borehole 5*c* is not adequate to deliver the delivery medium 4 from there, the pump 2 is connected mechanically to the transmission system 6 by way of the drive shaft 7. The pump 2 can thus be used at a greater depth. The greater depth is made up of the depth of the switch 5*d* and the length of the drive shaft 7.

The mechanical connection of the pump 2 to the transmission system 6 by way of the drive shaft 7 allows the motor 3 also to be cooled and operated without failure in the shaft 5*d* with this variant. The drive shaft 7 is embodied as a combination of an internal riser and the actual shaft, which becomes the delivery line 9 on the way up from the level of the transmission system 6.

The invention claimed is:

1. A pump device for delivering a delivery medium out of a deep borehole leading from a ground level into an interior of earth and lined in sections with a borehole piping, comprising:

a pump arranged within the borehole piping;

a motor arranged outside of the borehole piping for driving the pump and arranged at a predefined delivery depth below the ground level; and a torque transmitting device arranged below the ground level and laterally penetrating the borehole piping for connecting the motor to the pump below the ground level.

2. The pump device as claimed in claim 1, wherein the torque transmitting device comprises a transmission system.

3. The pump device as claimed in claim 2, wherein the pump is arranged at the predefined delivery depth of the motor below the ground level, and wherein the transmission system and the pump form a structural unit.

4. The pump device as claimed in claim 2, wherein the pump is arranged at a greater depth below the predefined delivery depth of the motor, and wherein the transmission system and the pump are connected by a drive shaft.

5. The pump device as claimed in claim 4, wherein the drive shaft is displaced along the deep borehole for transmitting a torque to the pump at different bore depths.

6. The pump device as claimed in claim 1, wherein the deep borehole is extended by a shaft.

7. The pump device as claimed in claim 6, wherein the shaft is exposed in an upper section of the borehole piping.

8. The pump device as claimed in claim 6, wherein the motor is arranged in the shaft.

9. The pump device as claimed in claim 1, wherein the motor is connected to a cooling system by a cooling line.

10. The pump device as claimed in claim 9, wherein the cooling system is arranged at the ground level or above the ground level such that the cooling line is configured to extend from the motor at the predefined delivery depth below the ground level to the cooling system at the ground level or above the ground level.

11. The pump device as claimed in claim 1, wherein the motor is connected to the torque transmitting device by a quick-release plug-in connector.

12. A method for assembling a pump device for delivering a delivery medium out of a deep borehole leading from a ground level into an interior of earth and lined in sections with a borehole piping, comprising:

providing a pump within the borehole piping;

arranging a motor outside of the borehole piping for driving the pump and at a predefined delivery depth below the ground level;

providing a torque transmitting device below the ground level; and connecting the motor to the pump by the torque transmitting device laterally penetrating the borehole piping below the ground level.

* * * * *